US007084576B2

(12) United States Patent
Ito

(10) Patent No.: US 7,084,576 B2
(45) Date of Patent: Aug. 1, 2006

(54) ACTIVE EL DISPLAY HAVING AN INVERTER IN EACH PIXEL THEREOF

(75) Inventor: Nobuyuki Ito, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 10/512,660

(22) PCT Filed: Apr. 25, 2003

(86) PCT No.: PCT/JP03/05369

§ 371 (c)(1),
(2), (4) Date: Oct. 25, 2004

(87) PCT Pub. No.: WO03/091982

PCT Pub. Date: Nov. 6, 2003

(65) Prior Publication Data

US 2005/0225252 A1 Oct. 13, 2005

(30) Foreign Application Priority Data

Apr. 25, 2002 (JP) ..... 2002-124136

(51) Int. Cl.
*G09G 3/10* (2006.01)
*G09G 3/30* (2006.01)

(52) U.S. Cl. ..... 315/169.3; 345/77

(58) Field of Classification Search ..... 315/161, 315/169.3; 345/55, 76–77, 84
See application file for complete search history.

(56) References Cited

U.S. PATENT DOCUMENTS 6,501,466 B1 * 12/2002 Yamagishi et al. ..... 345/204
6,693,385 B1 * 2/2004 Koyama ..... 315/169.1
6,774,578 B1 * 8/2004 Tanada ..... 315/169.4
6,937,222 B1 * 8/2005 Numao ..... 345/98

FOREIGN PATENT DOCUMENTS

| | | |
|---|---|---|
| JP | 64-7635 | 2/1989 |
| JP | 3-273087 | 12/1991 |
| JP | 2001-159881 | 6/2001 |
| JP | 2003-112538 | 4/2003 |

OTHER PUBLICATIONS

S. Miyashita, Y. Imamura, H. Takeshita, M. Atobe, O. Yokoyama, Y. Matsueda, T. Miyazawa, M. Nishimaki. "Full Color Displays Fabricated by Ink-Jet Printing." IDW (2001). 1399-1402.

Akira Yumoto, Mitsuru Asano, Hiroshi Hasegawa and Mitsunobu Sekiya. "Pixel-Driving Methods for Large-Sized Poly-Si AM-OLED Displays." IDW (2001). 1395-1398.

Mayumi Mizukami, Kazutaka Inukai, Hirokazu Yamagata, Toshimitsu Konuma, Takeshi Nishi, Jun Koyama, Shumpei Yamazaki. "36.1: 6-Bit Digital VGA OLED." SID Digest (2000). 912-915.

* cited by examiner

*Primary Examiner*—Thuy Vinh Tran
(74) *Attorney, Agent, or Firm*—Ladas & Parry LLP

(57) ABSTRACT

An organic EL display which is capable of carrying out scanning time efficiently in the view of power consumption, and is capable of providing a normally white display. The display is formed by arranging a plurality of pixel units having a light emitting unit and a semiconductor switching circuit for operating the light emitting unit to emit light. The semiconductor switching circuit of each pixel includes an inverter, and operating output for operating the light emitting unit to emit light via said inverter. When each pixel is not selected, the light emitting unit emits light. When each pixel is selected, the light emitting unit does not emit light A normally white display is provided as a whole.

12 Claims, 15 Drawing Sheets

FIG. 7 - PRIOR ART

NORMALLY BLACK DISPLAY

FIG. 8 - PRIOR ART

FIG. 11 - PRIOR ART
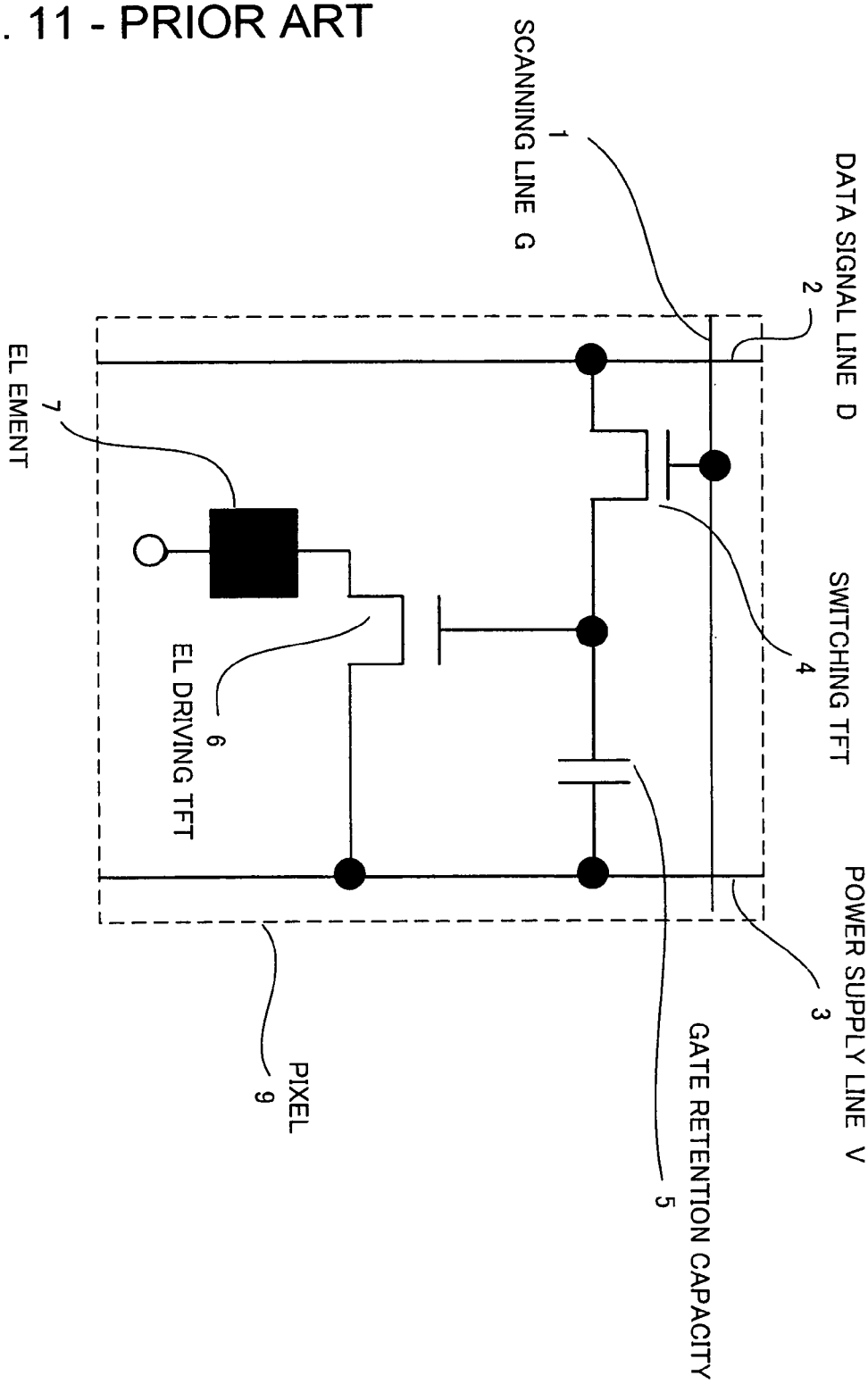

FIG. 12 - PRIOR ART
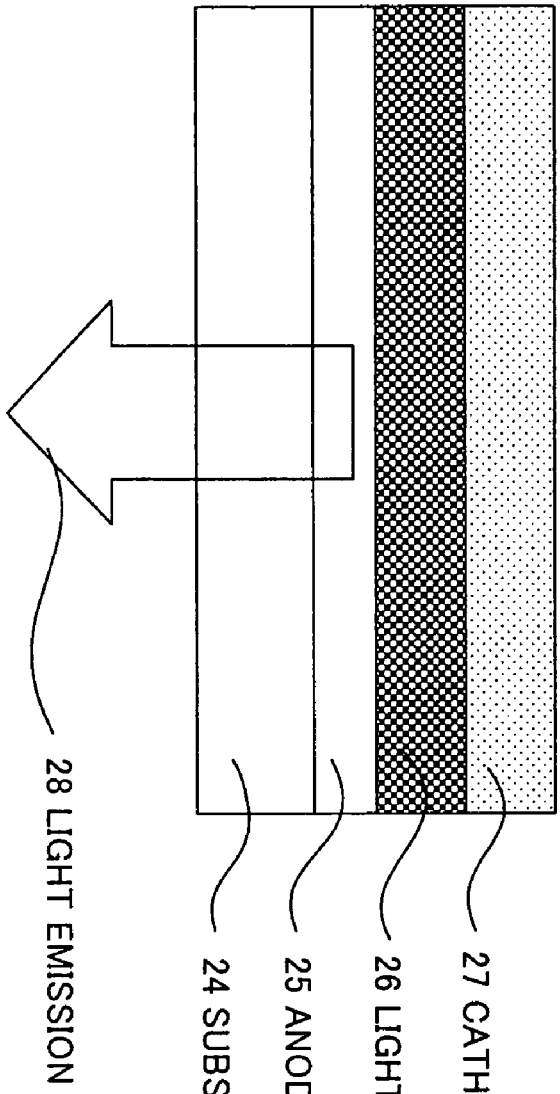

FIG. 13 - PRIOR ART
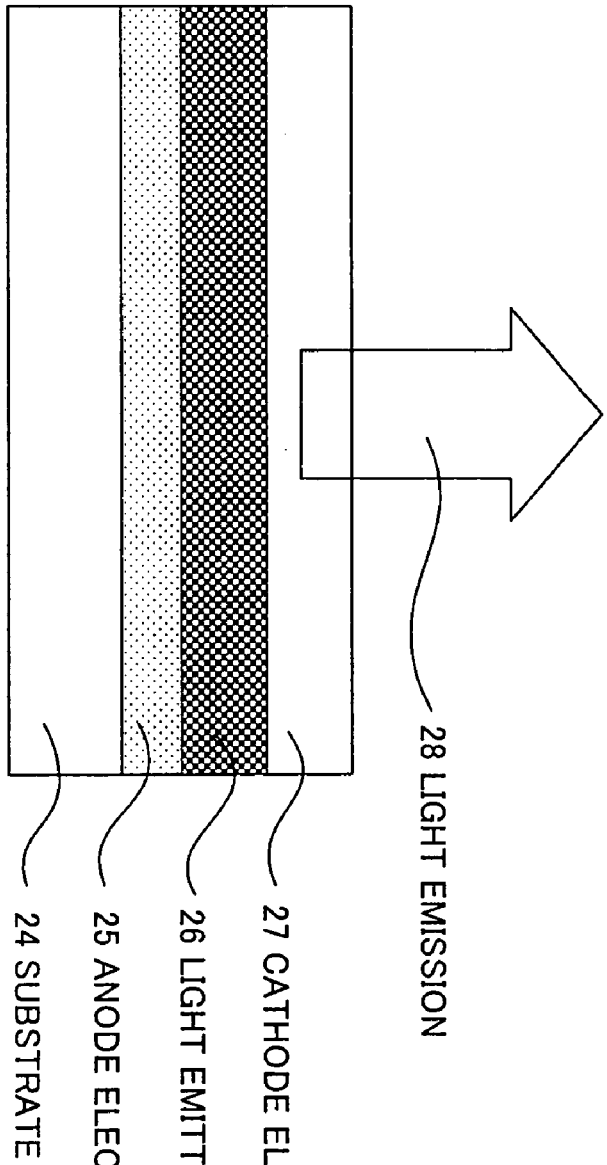

FIG. 15 - PRIOR ART
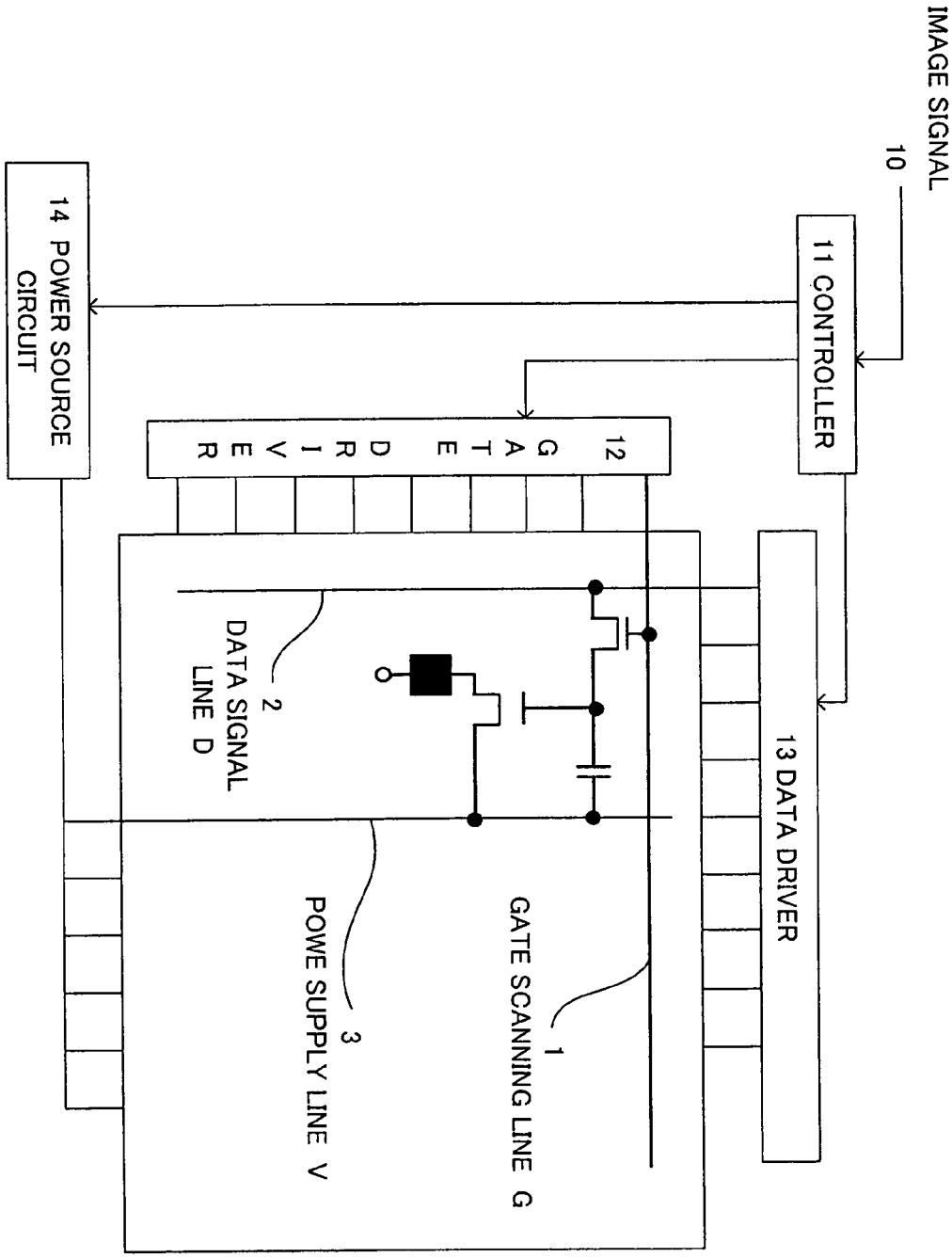

ACTIVE EL DISPLAY HAVING AN INVERTER IN EACH PIXEL THEREOF

TECHNICAL FIELD

The present invention relates to an EL display that is a display utilizing electroluminescence elements (hereinafter, electroluminescence is expressed by EL, also referred to as EL element), and an electronic device using the EL display for a display unit. The invention particularly relates to an active matrix display (hereinafter, also referred to as an active EL display) that uses EL elements and is driven by semiconductor elements.

BACKGROUND ART

In recent years, flat displaying device (hereinafter, referred to as a flat display) are used in many fields and in many places, and their importance is being increased as the information age progress.

At the present day, a liquid crystal display (hereinafter, referred to as LCD) is a typical flat display. However, as flat displays based on a displaying principle that is different from that of the LCD, organic EL, inorganic EL, plasma display panels (hereinafter, referred to as PDP), light emitting diode displays (hereinafter, referred to as LED), vacuum fluorescent displays (hereinafter, referred to as VFD), field emission displays (hereinafter, referred to as FED) and the like are developed actively.

These new flat displays are called spontaneous light emitting type displays, and they differ greatly from LCD in the following points and have excellent characteristics which are not provided to LCD.

The LCD is called a light receiving type display. The liquid crystal does not emit light and operates as a so called shutter which transmits or shields external light so as to configure a display.

For this reason, the LCD requires light sources, in general, requires back light.

On the contrary, the spontaneous light emitting type displays do not require individual light sources because the displays themselves emit light.

In the light receiving displays such as LCD, back light is always on regardless of a mode of display information. Thus, these displays consume electric power which is approximately the same as the electric power in a full displaying state.

On the contrary, in the spontaneous light emitting type displays, since only a part which should be on according to display information consumes electric power, these devices have an advantage such that the power consumption is less than the light receiving type displays in principle.

In LCD, since light of the back light source is shield so that a dark state is obtained, it is difficult to eliminate light leakage completely, even in a small amount. On the contrary, in the spontaneous light emitting type displays, since a non-emitting state is just a dark state, an optimal dark state can be easily obtained, and the spontaneous light emitting type displays have an overwhelming advantage in contrast.

Moreover, since the LCD utilizes polarization control due to double refraction of the liquid crystal, its so called view angle dependence, in which a displaying state greatly changes according to an observation direction, is strong. The spontaneous light emitting type displays, however, scarcely have such a problem.

Since the LCD utilizes an alignment change, originated from dielectric anisotropy of the liquid crystal as an organic elastic substance, response time to an electric signal is 1 ms or more in principle.

On the contrary, since the above technique, which is being developed, utilizes carrier transition, electron emission, plasma discharge and the like such as electron/hole, the response time has ns digits. The response speed is incomparably higher than the liquid crystal, and a problem of afterimage of an animation caused by low speed response in LCD does not occur.

Among the above, the study of organic EL is particularly active.

The organic EL is also called OEL (Organic EL) or organic light emitting diode (OLED).

An OEL element and an OELD element are configured so that an EL layer comprising an organic compound is sandwiched in between a pair of electrode, an anode and a cathode. This configuration is based on a laminated configuration of "anode electrode/hole injection layer/light emitting layer/cathode electrode" of Tang et al. (Japanese Patent No. 1526026).

Moreover, in contrast to Tang et al. using a low molecular weight material, Nakano et al. use a high molecular weight material (Japanese Patent Application Laid-Open No. 3-273087).

Further, efficiency is improved by using the hole injection layer or an electron injection layer, or a light emitting layer is doped with fluorescent dye or the like so that a luminescent color is controlled.

Here, a pixel electrode and a facing electrode correspond to either of the anode and the cathode, so that a pair of electrodes is formed.

All the layers provided in between the pair of electrodes are generally called EL layers, and above mentioned hole injection layer, a hole transportation layer, a light emitting layer, an electron transportation layer and an electron injection layer are included.

FIG. 12 is a diagram showing a sectional configuration of an organic EL element.

The organic EL emits light by applying an electric field between the electrodes so as to apply the current to the EL layer. Conventionally, only fluorescence, light emission when returning to the ground state from the singlet excited state, is used. However, phosphorescence, light emission when returning to the ground state form the triplet excited state, can be effectively utilized due to recent studies. And thus, the efficiency is improved.

Normally, one electrode is formed on a light transmitting supporting substrate 24 such as a glass substrate or a plastic substrate, and an EL layer (light emitting layer) 26 and a facing electrode are formed in this order.

The electrode to be formed on the substrate may be an anode 25 or a cathode 27, and as a result, there are a bottom emission configuration shown in FIG. 12, wherein light is emitted 28 to the substrate side, and a top emission configuration shown in FIG. 13, wherein light is emitted 28 to an opposite direction to the substrate.

In the case of the top emission configuration, light transmittance is not required to the substrate.

A study is being conducted in which light taking-out efficiency is improved by taking out the light emission deactivated due to optical waveguide effect of the light transmitting substrate, by using a low refractive index material.

Though not shown in FIGS. 12 and 13, since the organic EL element is remarkably deteriorated due to water and oxygen, an inactive gas is generally filled so that the element does not come into contact with water or oxygen, and then, another substrate is used or so called sealing is carried out by thin film evaporation, so that reliability is secured.

As a method for forming an EL layer, a vacuum evaporation method is generally used for a low molecular weight material, and spin coating, a printing method or a transfer method is used for a high molecular weight material, in a form of a solution.

When a color display is manufactured by forming fine pixels with different light emitting color materials, a mask evaporation method is used for a low molecular weight material, and an ink-jet method, the printing method, the transfer method or the like is used for a high molecular weight material.

When the organic EL element is utilized as a display, similarly to LCD, its system can be roughly divided into a passive matrix mode and an active matrix mode, according to an electrode configuration and to a driving method.

The passive matrix mode has a simple configuration such that a pair of electrodes is formed with a horizontal electrode and a vertical electrode, which crosses each other with an EL layer in between. In order to display an image, however, instantaneous brightness should be heightened by a multiple of a number of scanning lines due to time-divisional scanning. The instantaneous brightness of the organic EL over 10000 cd/m$^2$ is required in displays of normal VGA or more. And thus, a lot of practical problems as a display will occur.

In the active matrix mode, a pixel electrode is formed on a substrate formed with TFT, and an EL layer and a facing electrode are formed. Its configuration is more complicated than that of the passive matrix mode, but this mode has a lot of advantages as the organic EL display in light emitting brightness, power consumption, and crosstalk.

Further, since the active matrix mode displays using polysilicon films has higher electric field effect mobility than that of amorphous silicon films, a high current process on TFT is possible, and this mode is suitable for driving the organic EL as an electric current driving element.

Since a high speed operation is possible in a polysilicon TFT, various control circuits, which are conventionally processed by external ICs, are formed on the same substrate as displaying pixels, and the display has a lot of advantages such as miniaturization of the display, reduction of the cost, multifunction and the like.

As mentioned above, the organic EL display has a lot of properties. However, it has practical disadvantages in comparison with the light receiving type LCD.

In the LCD, with the back light being on, the light transmission and non-light transmission of each pixel is switched by a shutter effect, and thus, state of brightness and darknesss is controlled so that an image is displayed. For this reason, even if a background is in a bright state and the image information is in a dark state, namely, normally white display, or even if the background is in the dark state and the image information is in the bright state, namely, a normally black display, the power consumption is not changed, and either can be selected according to applications or user's preference.

On the contrary, in the conventional organic EL displays, since the bright state is created by light emission, the so called normally black display, in which the background not emitting light is in the dark state and the image information is in the bright state, cannot be avoided.

Regardless of such a technical aspect, the normally white display is preferable for text display because of the very long cultural history such that characters are written on white paper using writing instruments.

In the conventional organic EL displays of the normally black display, display is as shown in FIG. 7, and thus this display is not suitable for user's preference.

As mentioned above, the current organic EL displays are characterized by contrast and high animating performance, and they are suitable for so called graphic display such as graphic user interface (GUI) images and animation display. These displays are not, however, suitable for text display which requires the normally white display.

In the conventional displays, information to be displayed differs according to instruments to which displays are installed, such as TV for displaying animations and PC for displaying still images and text.

However, when all instruments such as TV, PC, digital camera, and PDA are connected to a network due to the development of the internet and the improvement of a communicating speed, a function for displaying information, of which animations, still images, texts and the like are combined, is required to displays.

For example, while an animation is being displayed on a part of the display, a text is displayed on another part. Like such a case, it is required that various kinds of information are displayed on one display.

In order to provide the normally white display, which is popular among users, with the spontaneous light emitting type organic EL displays, it is necessary to turn on all the pixels, and then, turn off the pixels on which image information are present. This method cannot take enough advantage of less power consumption, at the time, when only a portion which should be on is turned on according to the display information.

Conventionally, there is no display which can provide normally white display efficiently while taking advantage of the excellent performance, of the spontaneous light emitting type organic EL displays, at the same time.

FIG. 15 is a diagram showing a signal processing system of a conventional active matrix mode organic EL display.

A gate driver 12 and a data driver 13 are operated according to a scanning signal and a data signal controlled by a controller 11, respectively. Thus, ON/OFF state of the pixels is controlled.

A power source circuit 14 is for supplying an electric current to an organic EL element which is one kind of light emitting diode. Electric current is supplied to pixels which are controlled to be on, and the organic EL element emits light.

In such an active matrix mode organic EL device, in addition to power consumption of the element due to the pixel light emission, power consumption due to the driver operation of the gate driver 12 and the data driver 13 is important as the entire display system.

That is, even if the light emitting area, which is determined by a total number of light emitting pixels, is the same, when the power consumption of the drivers is small, the entire display consumes low power, being an efficient display.

The power consumption of the drivers is determined by an operating frequency, namely, a number of times of rewriting a signal, and thus, as the operating frequency is low and the frequency of rewriting a signal is fewer, the power consumption can be lower.

FIG. 11 is a typical pixel circuit configuration of a conventional organic EL display.

The circuit is configured by a switching TFT (4), a gate retention capacity (5), a driving TFT (6), and an EL element (7), in addition to each bus line of a scanning line G (1), a data signal line D (2), and a power supply line V (3).

When a gate of the switching TFT (4) selected by the scanning line G (1) is opened and a signal voltage according to light emitting intensity is applied to a TFT source from the data signal line D (2), a gate of the driving TFT (6) is opened according to a level of the signal voltage in an analog manner. This state is retained at the gate retention capacity (5).

When the voltage is applied to a source of the driving TFT (6) from the power supply line V (3), an electric current according to an opening level of the gate flows through the EL element (7), and the EL element (7) emits light according to the signal voltage in gradation.

In a display having such a circuit configuration, at the normal time, when the switching TFT (4) is not selected, the organic EL element (7) is in the non-light emitting state, and when the switching TFT (4) is selected, the organic EL element (7) will be in the light emitting state and will be in normally black display shown in FIG. 7 is provided.

Besides the above, the circuit configuration and the driving method of the organic EL display includes digital gradation driving methods such as a method wherein a number of TFTs is further increased ("Pixel Driving Methods for Large-Sized Poly-si AM-OLED Displays" by Yumoto et al., Asia Display/IDW' 01 P. 1395–1398), time divisional gradation ("6-bit Digital VGA OLED" by Mizukami et al., SID' 00 P. 912–915), and area divisional gradation ("Full Color Displays Fabricated by Ink-Jet Printing" by Miyasita et al., Asia Display/IDW' 01 P. 1399–1402). They provide the normally black display as well.

In order to provide the normally white display with the organic EL display, as shown in FIG. 8, all the gate scanning lines are selectively scanned, while selecting the data lines corresponding to the most of pixels with no image information and making the background in the light emitting state. At the same time, only data lines of pixels with image information need to be non-selected state and be in the non-light emitting state.

Since the background in the bright state, namely, selected pixels are inevitably present on all the scanning lines and the data lines, as scanning conditions, both the gate lines and data lines will be operated by entire screen scanning and entire screen selection.

Since the entire screen scanning and the entire screen selection are carried out, the power consumption for operating the drivers, for the gate driver and the data driver added together, becomes maximum.

DISCLOSURE OF THE INVENTION

As mentioned above, in order to provide normally white display in the conventional organic EL display, scanning to make the background into the light emitting state and scanning to make the image information into the non-light emitting state are carried out on an entire screen respectively. In this device, a number of scanning becomes larger than that of the normally white display in LCD or the like. Thus, also in the view of the power consumption, countermeasures for the above are required.

The present invention id to solve the above problem, and its object is to provide an organic EL display which is capable of carrying out scanning time efficiently in the view of the power consumption and capable of providing the normally white display.

A display of the present invention is formed by arranging a plurality of pixel units comprising a light emitting unit and a semiconductor switching circuit for operating the light emitting unit to emit light, wherein the semiconductor switching circuit of each pixel includes an inverter, an operating output for operating the light emitting unit to emit light is output via said inverter, when each pixel is not selected, the operating output is supplied to the light emitting unit via the inverter, so that the light emitting unit emits light, when selected, the operating output is not supplied to the light emitting unit via the inverter, so that the light emitting unit does not emit light, and a normally white display is provided as a whole.

And in the above mentioned display, the display comprises a control unit that determines whether the selected pixel is present or not on a scanning line, per respective scanning line, wherein when the selected pixel is not present on said scanning line, scanning is not carried out.

And further in the above mentioned display, when each pixel is selected, the operating output is supplied to the light emitting unit, so that the light emitting unit emits light, when not selected, the operating output is not supplied to the light emitting unit, so that the light emitting unit does not emit light, as circuit for providing a normally black display as a whole, beside said semiconductor switching circuit, a circuit, which does not have an inverter in the semiconductor switching circuit, is provided on each pixel, and a control unit, in which any of the circuit is selected, is provided per each pixel.

In the above mentioned display, the inverter is a TFT of a CMOS configuration.

An electronic device of the present invention is characterized in that the above mentioned display of the present invention is used for a display unit.

By having such a configuration, the display of the present invention can provide an organic EL display, which is capable of carrying out scanning time efficiently in the view of the power consumption and capable of providing the normally white display.

That is, for example, since the entire surface is in a light emitting state in the case of a non-selected state, as shown in FIG. 6, only a portion on which display information is present is selectively scanned to be in a non-light emitting state. As a result, the normally white display can be provided.

The control unit, which determines scanning or non-scanning according to display information on scanning lines, controls a controller (corresponding to a controller 11 in FIG. 15) according to a program. As a result, the function can be easily provided.

When this normally white display is compared with normally white display according to a conventional method (FIG. 8), the operating power consumption of drivers can be greatly reduced.

In the normally white display shown in FIG. 6 by the display of the present invention and the normally white display shown in FIG. 8 by the conventional device (FIG. 11), when areas of their light emitting units are the same, the electric powers required for light emission of the organic EL element are the same. However, since the operating power consumption of the drivers can be reduced in the display of the present invention, the entire power consumption can be reduced.

According to the present invention, by the spontaneous light emitting type display, such as organic EL and the like, the normally white display can be provided efficiently.

Further, a spontaneous light emitting type display such as organic EL and the like, which achieves excellent graphic display with high contrast and text display of normally white display preferred by general users simultaneously, can be obtained.

And further, an excellent electronic device equipped with a display of a spontaneous light emitting type display such as organic EL and the like, which achieves excellent graphic display with high contrast and text display of normally white display preferred by general users simultaneously, can be obtained.

BRIEF DESCRIPTION OF THE DRAWINGS

FIG. 11 is a circuit configuration diagram of one pixel of the conventional organic EL display;

FIG. 12 is a sectional view showing a configuration of an organic EL element;

FIG. 13 is a sectional view showing a configuration of the organic EL element;

FIG. 15 is a schematic configuration diagram showing the control circuit unit that controls an image signal in a conventional display.

BEST MODE FOR CARRYING OUT THE INVENTION

Embodiments of the present invention are explained with reference to the drawings.

Figure 1:
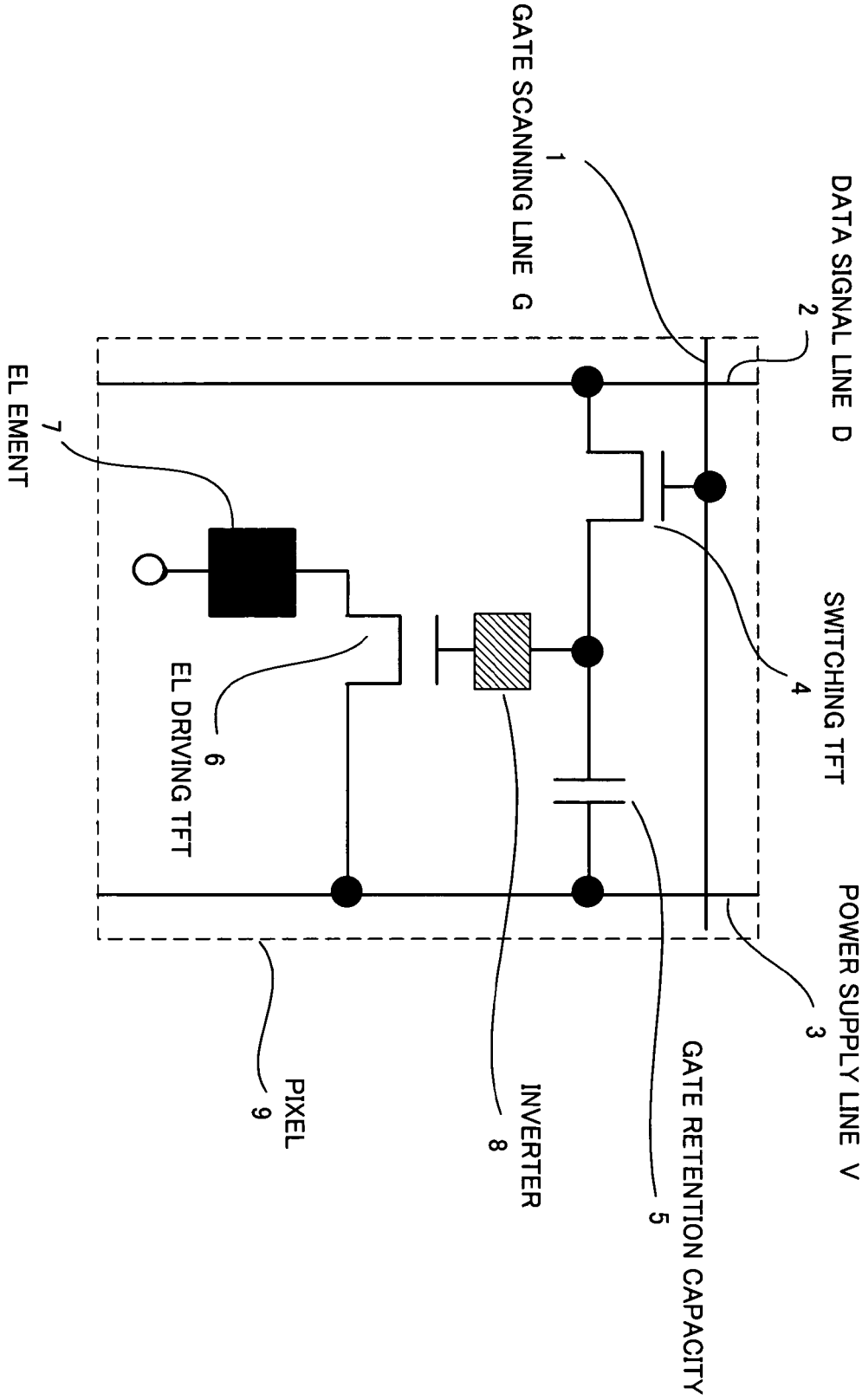
FIG. 1 is a circuit configuration diagram of one pixel as a characteristic portion of a display according to a first embodiment of the present invention.
Figure 2:
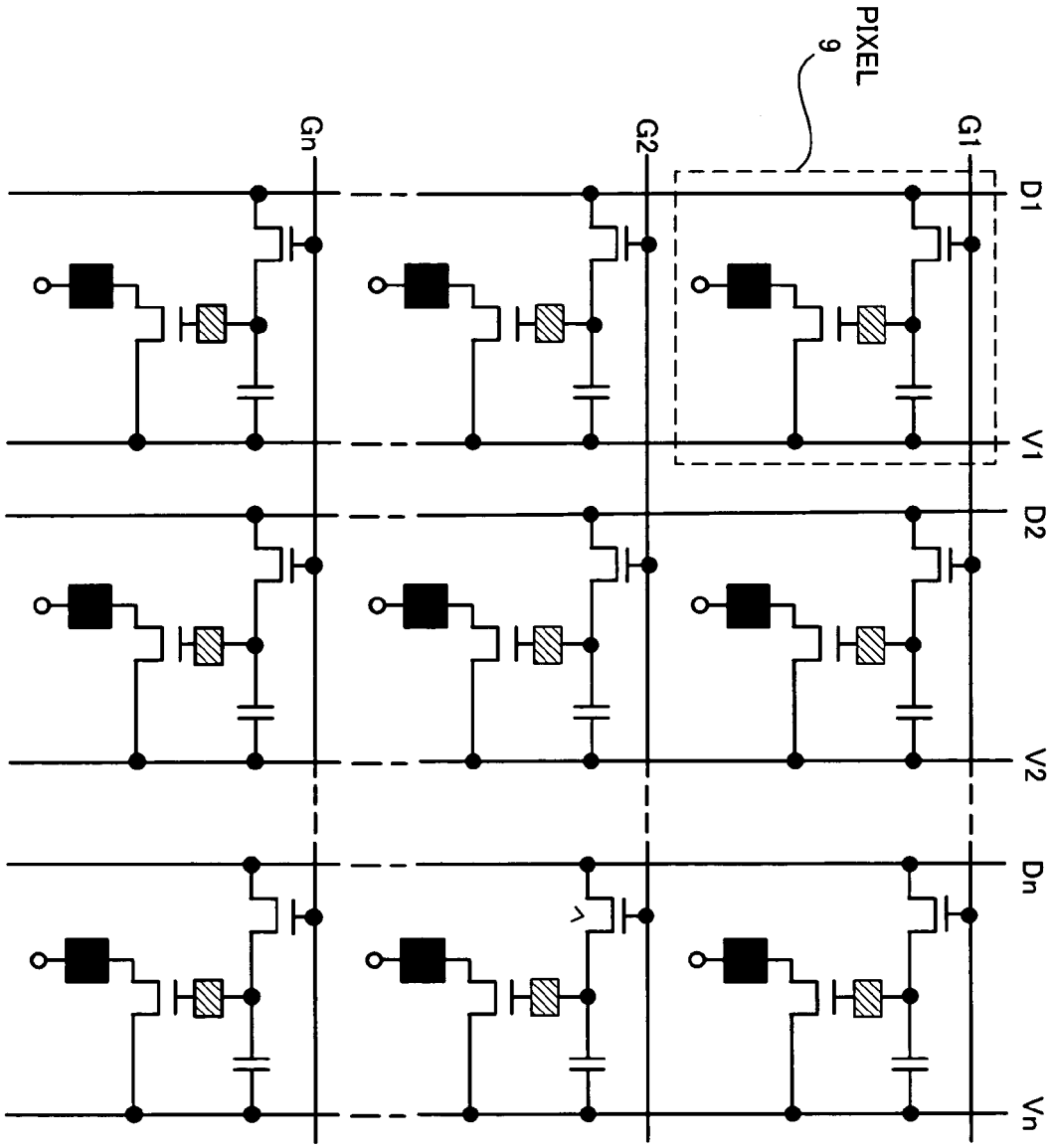
FIG. 2 is a circuit configuration diagram corresponding to a pixel arrangement of the display according to the first embodiment of the present invention.
Figure 3:
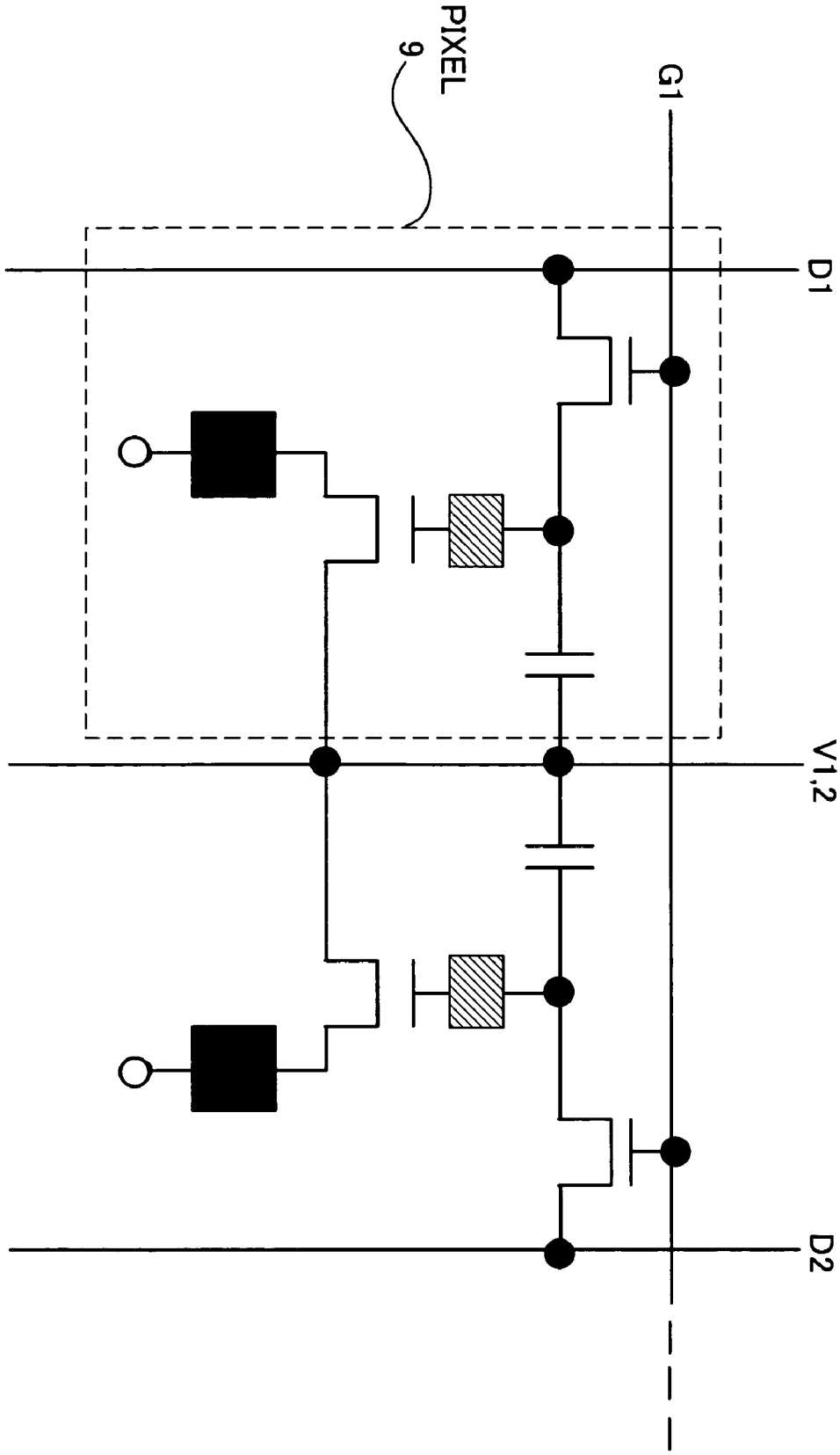
FIG. 3 is a circuit configuration diagram explaining a common power source V1, 2.
Figure 4:
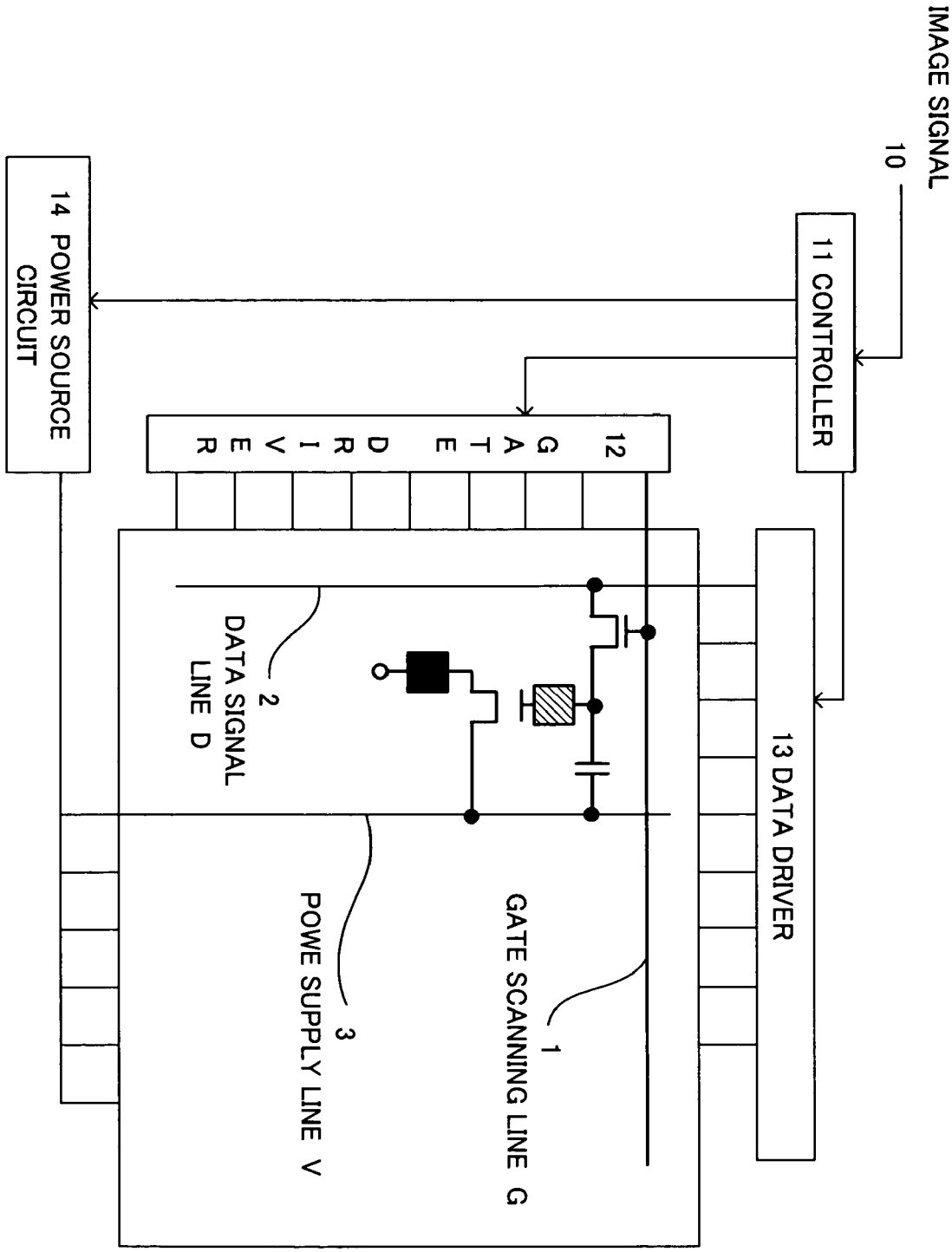
FIG. 4 is a schematic configuration diagram showing a control circuit unit that controls an image signal in the display according to the first embodiment of the present invention.
Figure 5:
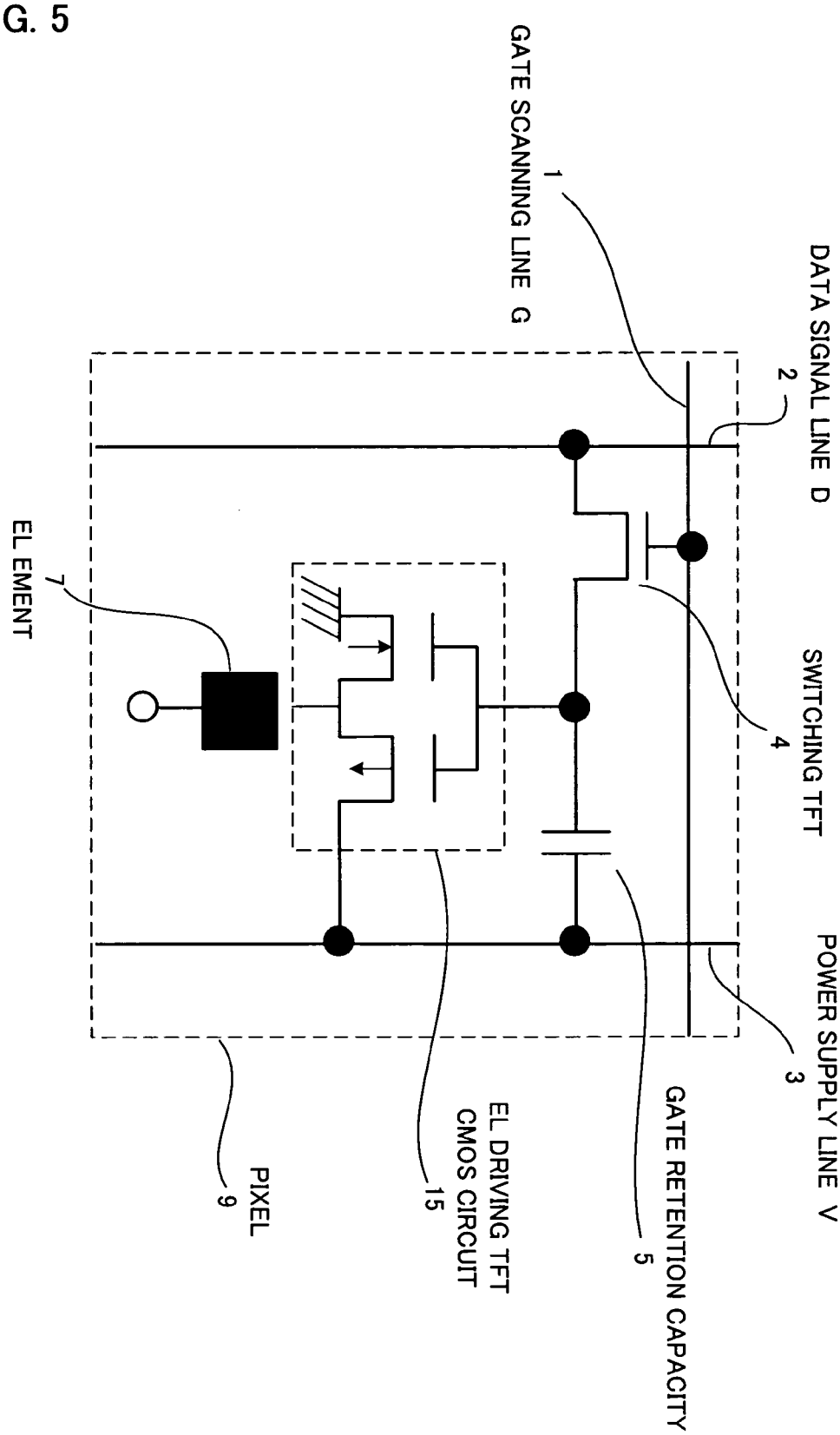
FIG. 5 is a circuit configuration diagram of one pixel explaining a circuit configuration of an inverter.
Figure 6:
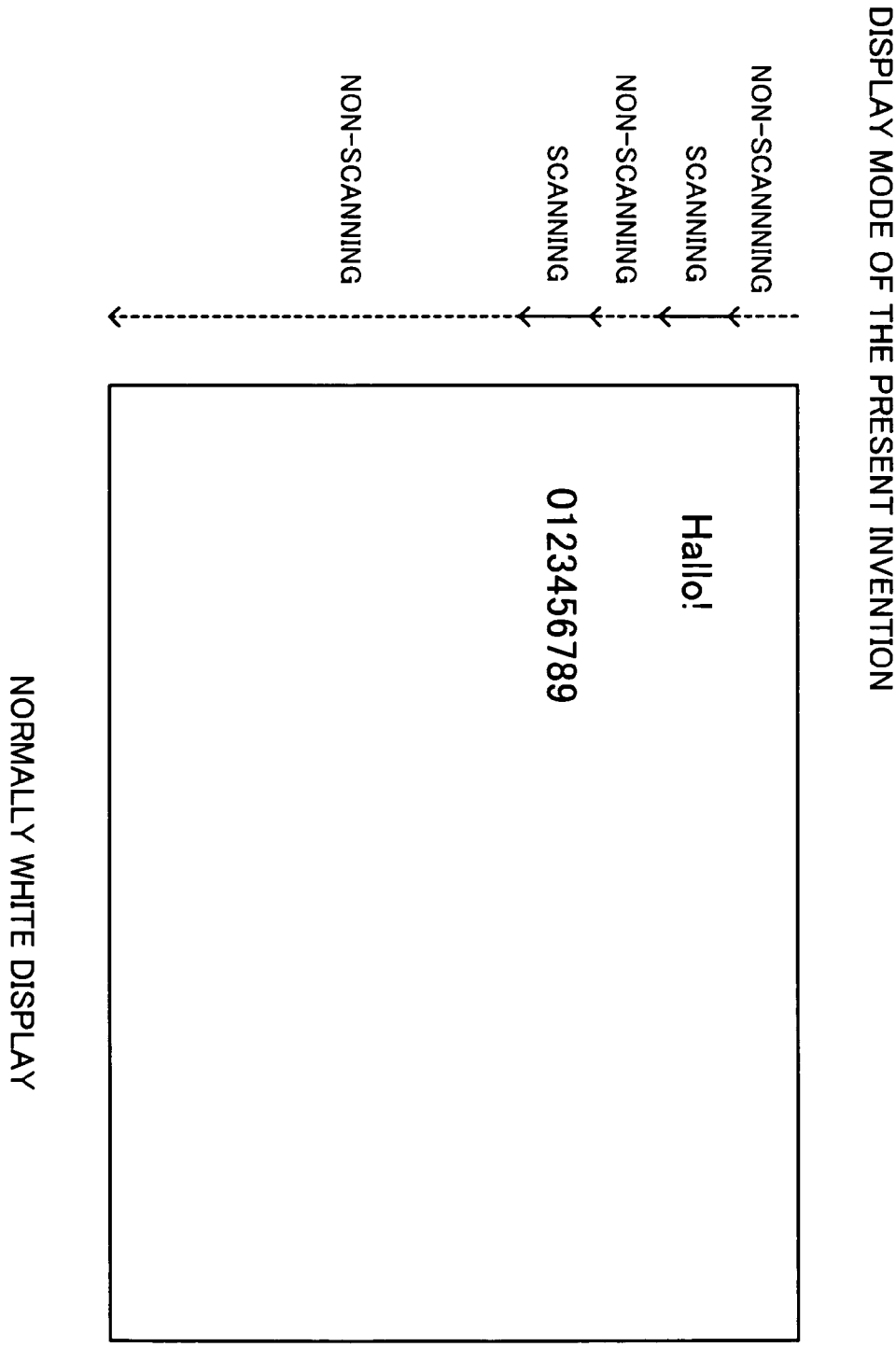
FIG. 6 is a diagram showing a normally white display method in an organic EL display of the present invention.
Figure 7:
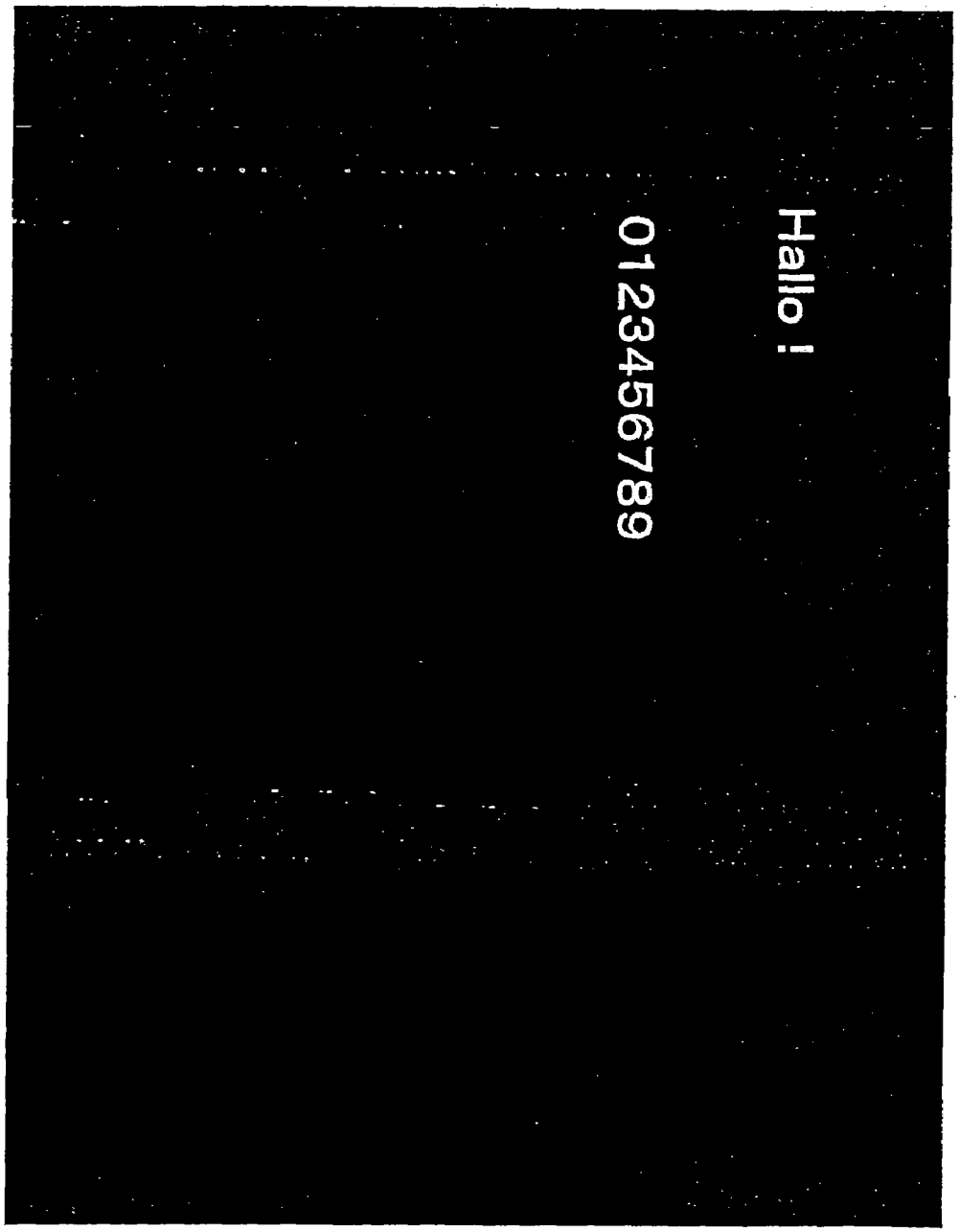
FIG. 7 is a diagram showing a normally black display as a display system of a conventional organic EL display.
Figure 8:
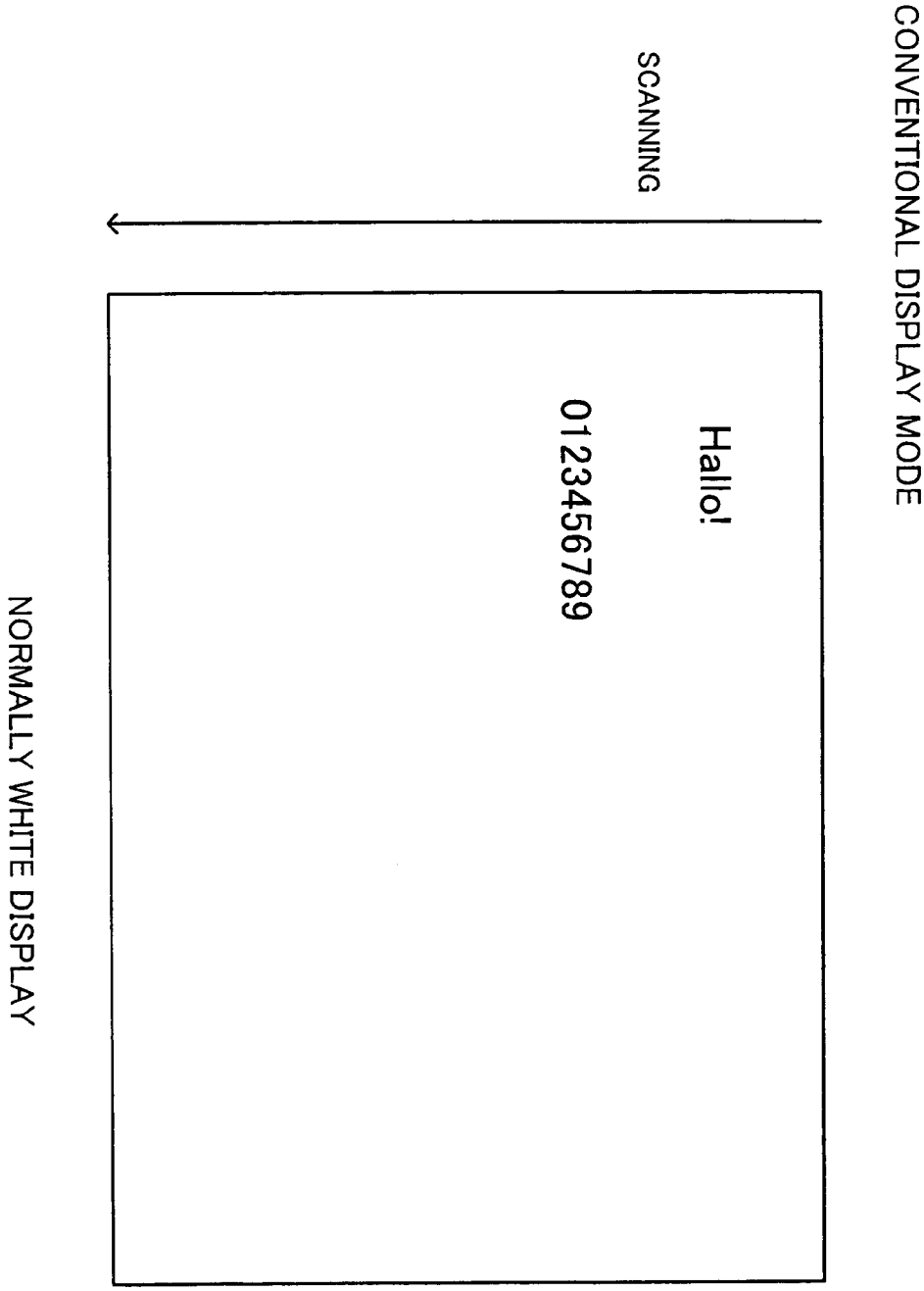
FIG. 8 is a diagram showing a display method when the normally white display is provided in the conventional organic EL display.
Figure 14:
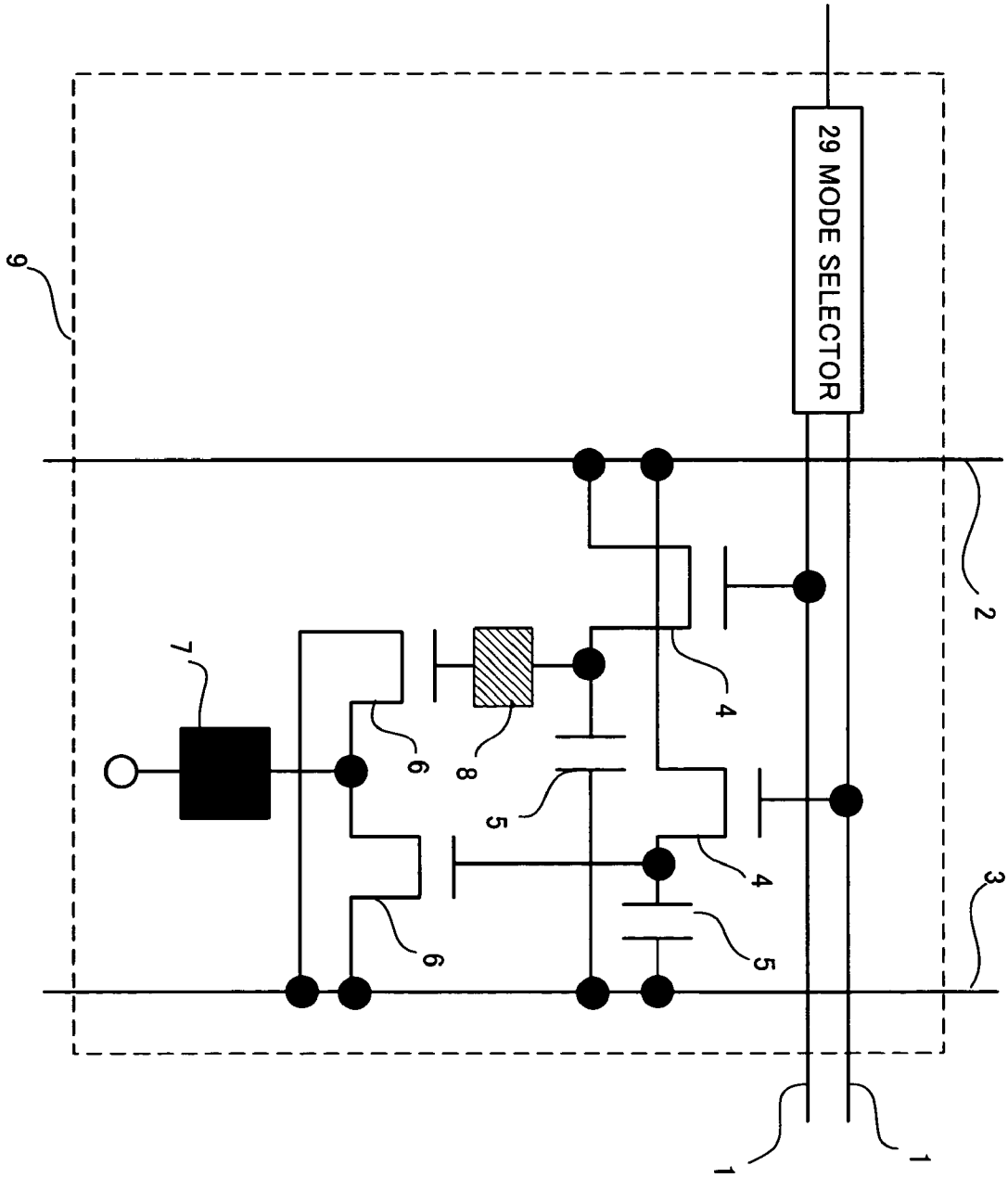
FIG. 14 is a circuit configuration diagram of one pixel as a characteristic portion of the display according to the second embodiment of the present invention.

FIG. 1 is a circuit configuration diagram of one pixel as a characteristic portion of a display according to a first embodiment of the present invention, and FIG. 2 is a circuit configuration diagram corresponding to a pixel arrangement of the display according to the first embodiment. FIG. 3 is a circuit configuration diagram explaining a common power source V1,2, and FIG. 4 is a schematic configuration diagram showing a control circuit that controls an image signal of the display according to the first embodiment. FIG. 5 is a circuit configuration diagram of one pixel explaining a circuit configuration of an inverter, and FIG. 14 is a circuit configuration diagram of one pixel as a characteristic portion of the display according to the second embodiment of the present invention.

Figure 9:
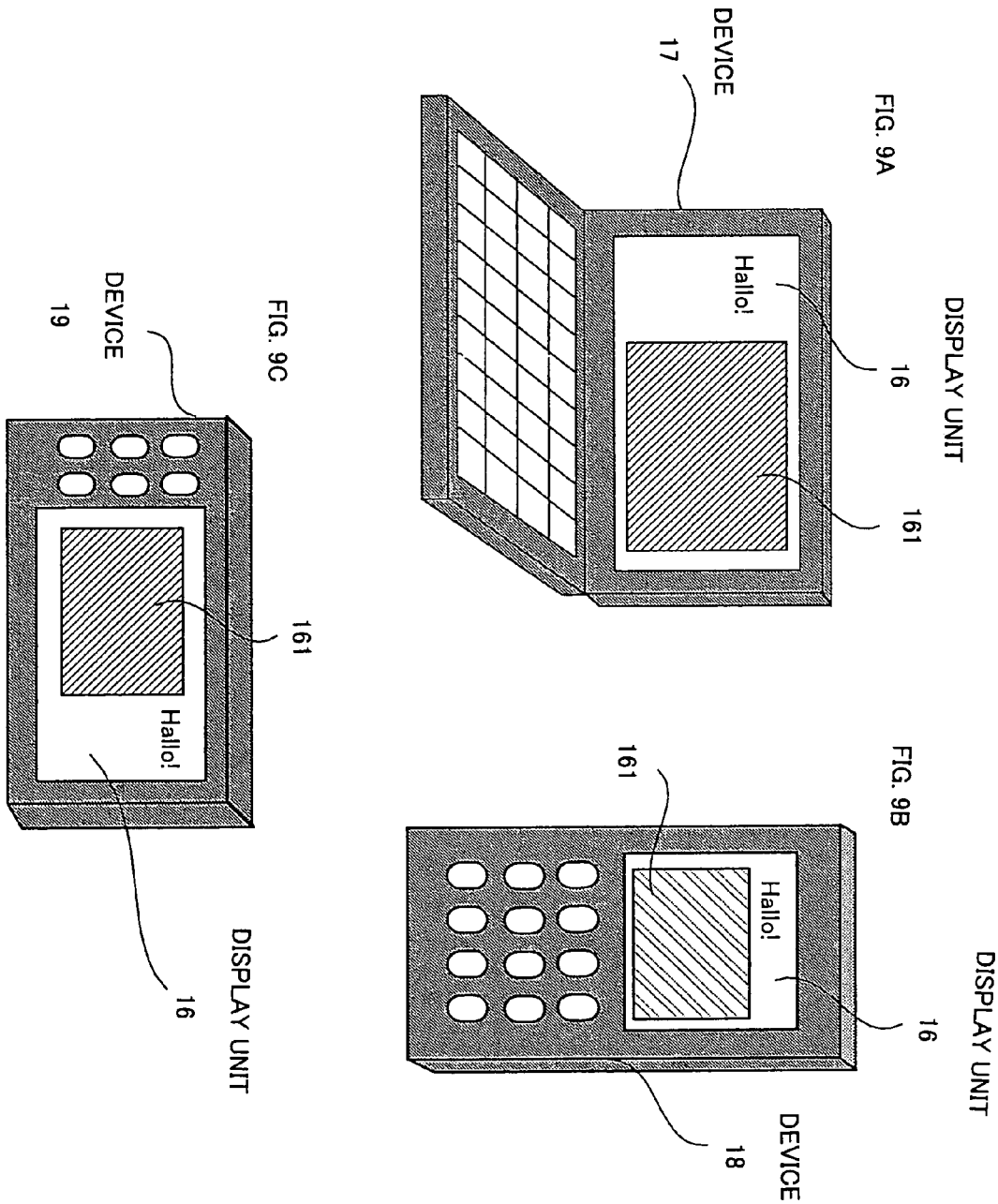
FIGS. 9A to 9C are diagrams each showing an example of electronic device and its display of the present invention.
Figures 10, 10A, 10B, 10C:
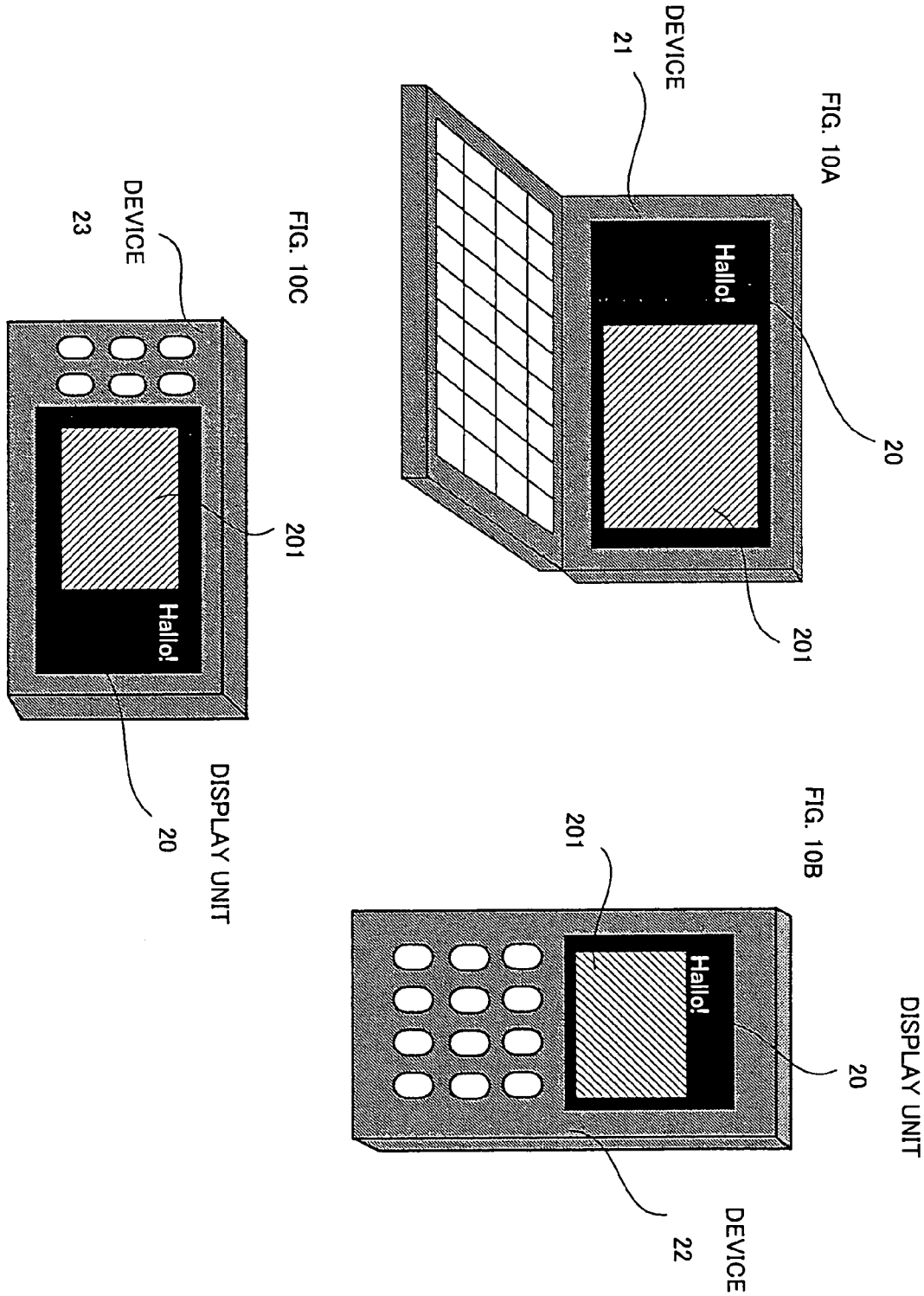
FIGS. 10A to 10C are diagrams each showing another example of electronic device and its display of the present invention.

FIGS. 9A to 9C are diagrams each showing an example of electronic device and its display of the present invention, and FIGS. 10A to 10C are diagrams each showing another example of the electronic device and its display of the present invention.

In FIGS. 1 to 5, 9, 10, and 14, 1 designates a gate scanning line G, 2 designates a data signal line D, 3 designates a power supply line V, 4 designates a switching TFT, 5 designates a gate retention capacity, 6 designates an EL driving TFT, 7 designates an EL element, 8 designates an inverter, 9 designates a pixel, 10 designates an image signal, 11 designates a controller, 12 designates a gate driver, 13 designates a data driver, 14 designates a power source circuit, 16 designates a display unit, 17, 18, and 19 designate devices (electronic devices), 29 designates a mode selector, and 161 and 201 designate a animation section (or picture area).

First, the display of the first embodiment of the present invention will be explained.

The display of this embodiment is, as shown in FIG. 1, an organic EL display in which the inverter (8) is installed to the driving TFT (6) of a pixel unit. Each pixel (9) is arranged in a matrix pattern as shown in FIG. 2, and only by turning the power on, the pixel emits light in a non-selected state.

For simplifying the wiring, adjacent pixels share a power source line, and as shown in FIG. 3, the common power source line V1, 2 may be provided.

As the inverter, for example, a TFT (CMOSTFT) having a CMOS configuration as shown in FIG. 5 is used.

Organic EL devices using CMOSTFT are disclosed in Japanese Patent Application Laid-Open Nos. 2000-208777, 2000-208778, 2000-216396, 2000-216397, 2000-216398, 2000-216399, and 2000-236097. They are completely different from this example in objects, installed places, and effects.

For example in the case of Japanese Patent Application Laid-Open No. 2000-208777, as shown in FIG. 29, a portion corresponding to the switching TFT (4) in FIG. 1 has a double gate configuration, so that an off current of the switching TFT is reduced.

The display of the second embodiment of the present invention will be explained.

In the display of the second embodiment, as shown in FIG. 14, both of a circuit, similar to that in the first embodiment, comprising an inverter (8) which provides the normally white display and a conventional normal circuit not comprising an inverter which provides the normally black display are provided on each pixel. And the mode selector (29) is provided as a control unit that selects either of the circuits, for each pixel, according to image information.

In this embodiment, either of the inverter circuit and the normal circuit is selected by the mode selector (29) which is controlled by a program in advance.

Embodiments of electronic devices of the present invention are explained below with reference to FIG. 9.

An electronic device (device 17) of the first embodiment shown in FIG. 9A is a PC (personal computer), an electronic device (device 18) of the second embodiment shown in FIG.

9B is a cellular phone, and an electronic device (device 19) of the third embodiment shown in FIG. 9C is a PDA. In any of these devices, the above mentioned display of the first embodiment or the display of the second embodiment is used as the display unit 16.

While displaying an animation or a graphic image, which the spontaneous light emitting type organic EL such as a graphic user interface (GUI) is good at displaying, in a form of the normally black display on a part of the display, text images such as mails and news can be shown on another part of the display in a form of the normally white display preferred by users.

When such composite information is displayed with the conventional organic EL display 20, trying not to increase the entire power consumption, the text portion will be in the form of the normally black display as shown in FIGS. 10A to 10C. For this reason, the display cannot provide in a user's desirable format, and thus, the devices 21, 22, and 23 cannot be used preferably.

The present invention is not limited to the above embodiments.

EXAMPLES

The present invention is further explained in way of examples.

Example 1

In an example 1, a display of the first embodiment was manufactured. Using a polysilicon film, a QVGA display of 4" was manufactured by arranging the organic EL elements having pixel configuration of comprising the CMOS configuration TFT shown in FIG. 5 as a driving TFT, in a matrix pattern shown in FIG. 2, on a glass substrate. And further, using the manufactured displaying unit as a displaying unit of a PC, displaying condition was checked.

The gate driver 12 and the data driver 13 shown in FIG. 4 were manufactured by using a polysilicon film.

It was manufactured by laminating the EL layer 25 having the configuration shown in FIG. 12, after connecting an ITO transparent electrode, which is patterned on the pixel driving TFT in a pixel form via passivation layer, as an anode 25 by spattering on the formed pixel circuit and driver circuit.

As to an organic EL layer 26, a light emitting organic material $Alq_3$ (tris(8-hydroxyquinoline) aluminum), and a hole injection layer TPD (N,N'-diphenyl-N,N'-bis (3methylphenyl)-1,-diphenyl-4,4'-diamine) were laminated.

As an cathode 27, MgAg alloy was used.

The layers were laminated in a sequence so that TPD and ITO will be in contact to each other.

A thickness of ITO was 150 nm. TPD (m) refined by a sublimination refining apparatus, which was sufficiently preheated under high vacuum, was loaded on a tungsten board, and film of 50 nm was formed by a resistance hating method.

$Alq_3$ refined by sublimination was loaded thereon using a quartz board, and film of 30 nm was formed by the resistance heating method.

MgAg alloy (Mg:Ag=10:1) wad vacuum evaporated into a thickness of 150 nm, and Ag was vacuum evaporated thereon into 200 nm as a protective layer. Finally the above was sealed by using a glass board and an UV curing sealing material which were separately prepared, so that a panel unit of the organic EL display was completed.

A controller and a power source circuit were connected to the organic EL panel so that the display was completed.

When the power source circuit of the organic EL display was operated, the entire surface emitted light, although neither of a gate scanning signal nor a data signal was supplied.

A light emitting color was green originated by $Alq_3$.

The organic EL display was installed so that the PC 17 shown in FIG. 9A was obtained.

When a monochrome text image in the form of the normally white display, created by a word processor software on the PC 17, is input as an image signal, a display of a background in the bright state and the text in the dark state, same as the text screen on the PC, could be obtained.

The controller was programmed such that the operation of the data driver is halted when a scanning line with no text information is not scanned and further, when a data signal is imparted to pixels with no text information. When the text image was displayed similarly to the above case, the displayed image was not changed. Thus, a device, wherein the power consumption is reduced, could be obtained.

A practical device, QVGA display of 4", was manufactured. When an image was displayed with practical brightness of 100 cd/$m^2$, the power consumption of the former was 100 mW, whereas the power consumption of the latter was reduced to 80 mW.

Example 2

In the example 2, in addition to the green light emitting material $Alq_3$ used in the example 1, DPVBi (1,4-bis(2,2-diphenylivinyl)biphenyl) as a blue light emitting material, and a substance obtained by adding 1.0 wt % of DCM (dicyanomethylene pyran derivative) to $Alq_3$ as a red light emitting material were used. These materials were vacuum evaporated in a three-color juxtaposition manner by mask vacuum evaporation so as to be subpixels, and a full-color display was manufactured. Except for the above, the example 2 was carried out by the same way as the example 1.

Since three primary colors R, G, and B were used, the background became white, and thus, text display of more preferable normally white display could be obtained.

Example 3

The example 3 was carried out by the same way as the example 1 except that a high molecular weight organic EL material was used instead of the low molecular weight organic EL material used in the example 1.

A hole injection layer was formed by applying PEDOT (polythiophene: Bayer CH8000), into a thickness of 80 nm, by spin coating and baking at 160° C.

The following high molecular weight organic EL materials, which were dissolved with a solvent to be in a liquid form, were vacuum evaporated on PEDOT in the three-color juxtaposition manner by an ink-jet method so as to be subpixels, and a full-color display was manufactured.

In order to protect the organic EL materials from deterioration due to moisture and oxygen, all the processes, including calcination of PEDOT through sealing, were carried out in a glove box substituted with nitrogen.

Similarly to the example 1, text display of excellent normally white display, wherein the power consumption is reduced, could be obtained.

Composition of Organic EL Layer Forming Coating Solution

Polyvinyl carbazole: 70 parts by weight
Oxadiazole compound: 30 parts by weight
Fluorescent dye: 1 part by weight
Monochlorobenzene (solvent): 4900 parts by weight When the fluorescent dye was cumarin 6, green color light emission with a peak of 501 nm was obtained, when the fluorescent dye was perylene, blue color light emission with a peak of 460 nm to 470 nm was obtained, and when the fluorescent dye was DCM, red color light emission with a peak of 570 nm was obtained.

Example 4

In the example 4, the display of the second embodiment was manufactured similarly to the example 1 except that a circuit configuration of the pixels was as shown in FIG. 14. Further, a display unit manufactured similarly was used as the display unit of an electronic device (personal digital assistant (PDA)), and its displaying condition was checked.

The controller was programmed so that the mode selector (19 in FIG. 14) sorted a conventional circuit and an inverter circuit in a case of image information, as shown in FIG. 9, of an animation and a text image being present in a mixed manner. When an image signal was input actually, the image of the animation and the text image of the normally white display being present in a mixed manner could be obtained smoothly.

The organic EL display was installed, so that a portable electronic device 18 driven by battery shown in FIG. 9B was obtained.

Comparative Example

In a comparative example, an organic EL display was manufactured similarly to the example 4 except that a circuit configuration of the pixels was as shown in FIG. 11. The portable electronic device driven by batter shown in FIG. 9B, on which the manufactured organic EL display was installed, was obtained.

When the image, of the animation and the text image of normally white display being present in a mixed manner shown in FIG. 9, was displayed similarly to the example 4, the power consumption of the display increased, and thus, the battery life became shorter than that in the example 4.

The examples of the present invention are explained, but the present invention is not limited to them.

The invention claimed is:

1. A display formed by arranging a plurality of pixel units each comprising a light emitting unit and a semiconductor switching circuit for operating the light emitting unit to emit light, wherein the semiconductor switching circuit of each pixel includes an inverter, and an operating output for operating the light emitting unit to emit light, which is output via the inverter to provide a normally white display as a whole, when each pixel is not selected, the operating output is supplied to the light emitting unit via the inverter, so that the light emitting unit emits light, or when each pixel is selected, the operating output is not supplied to the light emitting unit via the inverter, so that the light emitting unit does not emit light.

2. The display according to claim 1, comprising a control unit that determines whether the selected pixel is present or not on a scanning line, per respective scanning line, wherein when the selected pixel is not present on said scanning line, scanning is not carried out.

3. The display according to claim 2, wherein the pixel units each further comprise:

a second circuit, other than the semiconductor switching circuit, which does not have an inverter and provides a normally black display as a whole;

when each pixel is selected, the operating output is supplied to the light emitting unit, so that the light emitting unit emits light, or when not selected, the operating output is not supplied to the light emitting unit, so that the light emitting unit does not emit light; and a control unit, which selects either the semiconductor switching circuit which provides the normally white display or the second circuit which provides the normally black display.

4. The display according to claim 3, wherein the inverter is a TFT of a CMOS configuration.

5. An electronic device, wherein the display according to claim 3 is used for a display unit.

6. The display according to claim 2, wherein the inverter is a TFT of a CMOS configuration.

7. An electronic device, wherein the display according to claim 2 is used for a display unit.

8. The display according to claim 1, wherein the pixel units each further comprise:

a second circuit, other than the semiconductor switching circuit, which does not have an inverter and provides a normally black display as a whole;

when each pixel is selected, the operating output is supplied to the light emitting unit, so that the light emitting unit emits light, or when not selected, the operating output is not supplied to the light emitting unit, so that the light emitting unit does not emit light; and a control unit, which selects either the semiconductor switching circuit which provides the normally white display or the second circuit which provides the normally black display.

9. The display according to claim 8, wherein the inverter is a TFT of a CMOS configuration.

10. An electronic device, wherein the display according to claim 8 is used for a display unit.

11. The display according to claim 1, wherein the inverter is a TFT of a CMOS configuration.

12. An electronic device, wherein the display according to claim 1 is used for a display unit.

* * * * *